US006349142B1

(12) United States Patent
Teng

(10) Patent No.: US 6,349,142 B1
(45) Date of Patent: Feb. 19, 2002

(54) STRUCTURE OF SPEAKER USE ON SHIP

(76) Inventor: Yi-Chuan Teng, P.O. Box 82-144, Taipei (TW)

( * ) Notice: Subject to any disclaimer, the term of this patent is extended or adjusted under 35 U.S.C. 154(b) by 0 days.

(21) Appl. No.: 09/412,576

(22) Filed: Oct. 5, 1999

(51) Int. Cl.[7] ..... H04R 25/00

(52) U.S. Cl. ..... 381/386; 381/86; 381/389; 181/199

(58) Field of Search ..... 381/86, 386, 388, 381/389, 396; 181/149, 150, 199

(56) References Cited

U.S. PATENT DOCUMENTS 1,844,803 A * 2/1932 Seabert ..... 381/396
2,132,833 A * 10/1938 Quam ..... 381/396
2,155,474 A * 4/1939 Creager ..... 381/396
2,974,204 A * 3/1961 Supitilov ..... 381/396
4,853,966 A * 8/1989 Skrzycki ..... 381/86
5,703,335 A * 12/1997 Deutsch ..... 181/150
5,793,877 A * 8/1998 Tagg ..... 381/156
6,122,390 A * 9/2000 Rosswork ..... 381/86

FOREIGN PATENT DOCUMENTS

WO 90/14169 * 11/1990 ..... 381/396

* cited by examiner

*Primary Examiner*—Sinh Tran
*Assistant Examiner*—P. Dabney
(74) *Attorney, Agent, or Firm*—Morgan Lewis & Bockius LLP

(57) ABSTRACT

A structure of speaker for ship having a base seat, a vibration board connected to a vibration shaft, and a coil seat containing a coil, characterized in that a coil housing enclosing an iron block therein, being made from iron is mounted in between the base seat and the coil seat so as to obtain the effect of magnetism concentration, the magnetism is formed when a current is passed through the coil and the magnetism is concentrated at the iron block which in turn attracts the vibration shaft to move downward, and drives, the vibration board to produce vibration, which produce sound.

3 Claims, 6 Drawing Sheets

STRUCTURE OF SPEAKER USE ON SHIP

BACKGROUND OF THE INVENTION a) Technical Field of the Invention

The present invention relates to a structure of speaker for use on ship, and in particular, to speaker for which the majority of the parts forming the speaker are made from stainless steel, which is a good resistance against rust, and does not cause damages to speaker or loss of fidelity of sound.

b) Description of the Prior Art

A conventional type of speaker structure used on ship is shown in FIG. 1, which comprises a coil 4020 contained in an iron-made container 4020 in order to obtain magnetism concentration effect to allow a vibration board 4030 to vibrate and produce sound. The parts making up this conventional speaker are made from iron, and the speaker is functioned to provide information or warning to other ships. However, the environment of the ship is normally humid and the sea water is very corrosive to iron. As a result, the speaker rusts easily after a certain period of use on ship.

This will cause damages to the speaker and a loss of fidelity in sound production. If the rusty effect is too serious, the speaker may not produce any sound effect at all.

SUMMARY OF THE INVENTION

Accordingly, it is an object of the present invention to provide a structure of speaker for use on ship, which can prevent rust and does not easily damage when it is used on ship or used in outdoor.

An aspect of the present invention is to provide a structure of speaker for use on ship, having a base seat, a vibration board connected to a vibration shaft, and a coil seat containing a coil, characterized in that a coil housing enclosing an iron block therein, and being made from iron is mounted in between the base seat and the coil seat so as to obtain the effect of magnetism concentration, magnetism is formed when a current is passed through the coil, and the magnetism is concentrated at the iron block which in turn attracts the vibration shaft to move downward, driving the vibration board to produce vibrations, which produce a sound effect.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts. Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
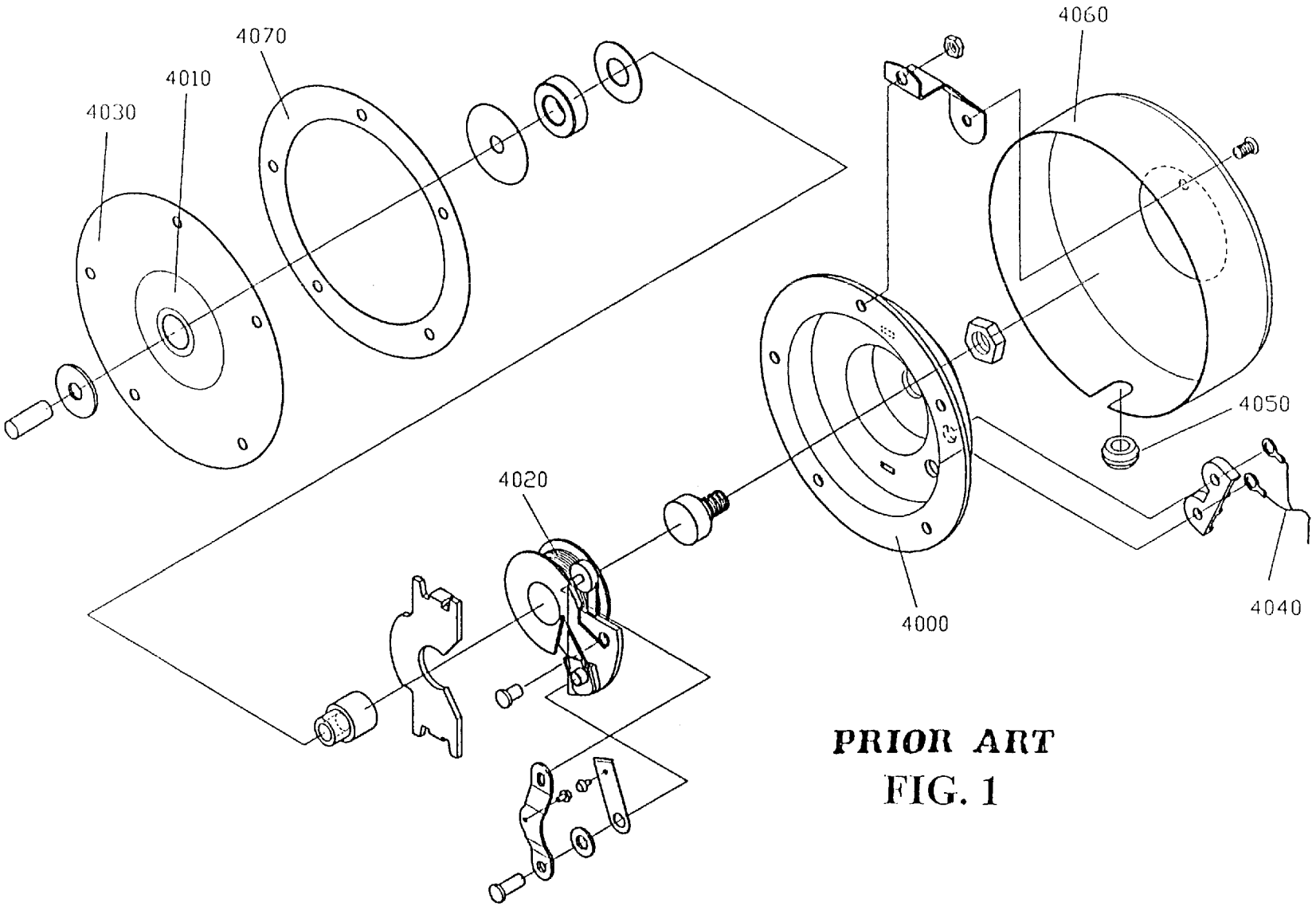
PRIOR ART FIG. 1
FIG. 1 is a perspective exploded view of a conventional speaker used on ships.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

FIG. 1 is a perspective exploded view of a conventional speaker used on ship. As can be seen from the figure, water moisture enters the housing 4060 via a mounting rubber ring 4050, which is used to hold a power source wire 4040, and causes the bottom seat and other parts of the speaker to rust. Although the internal structure of the speaker is rustproof, such as a rubber ring 4070 being mounted at the connection of the vibration board 4030 and the iron-made container 4000 to prevent the entry of water moisture, and the pad at the vibration board 4030 and the speaker connection 4010 being painted, the strong corrosive of sea water, the layer of paint will cause to strip and the vibration board 4030 becomes rusty after sometime of use.

Figure 2:
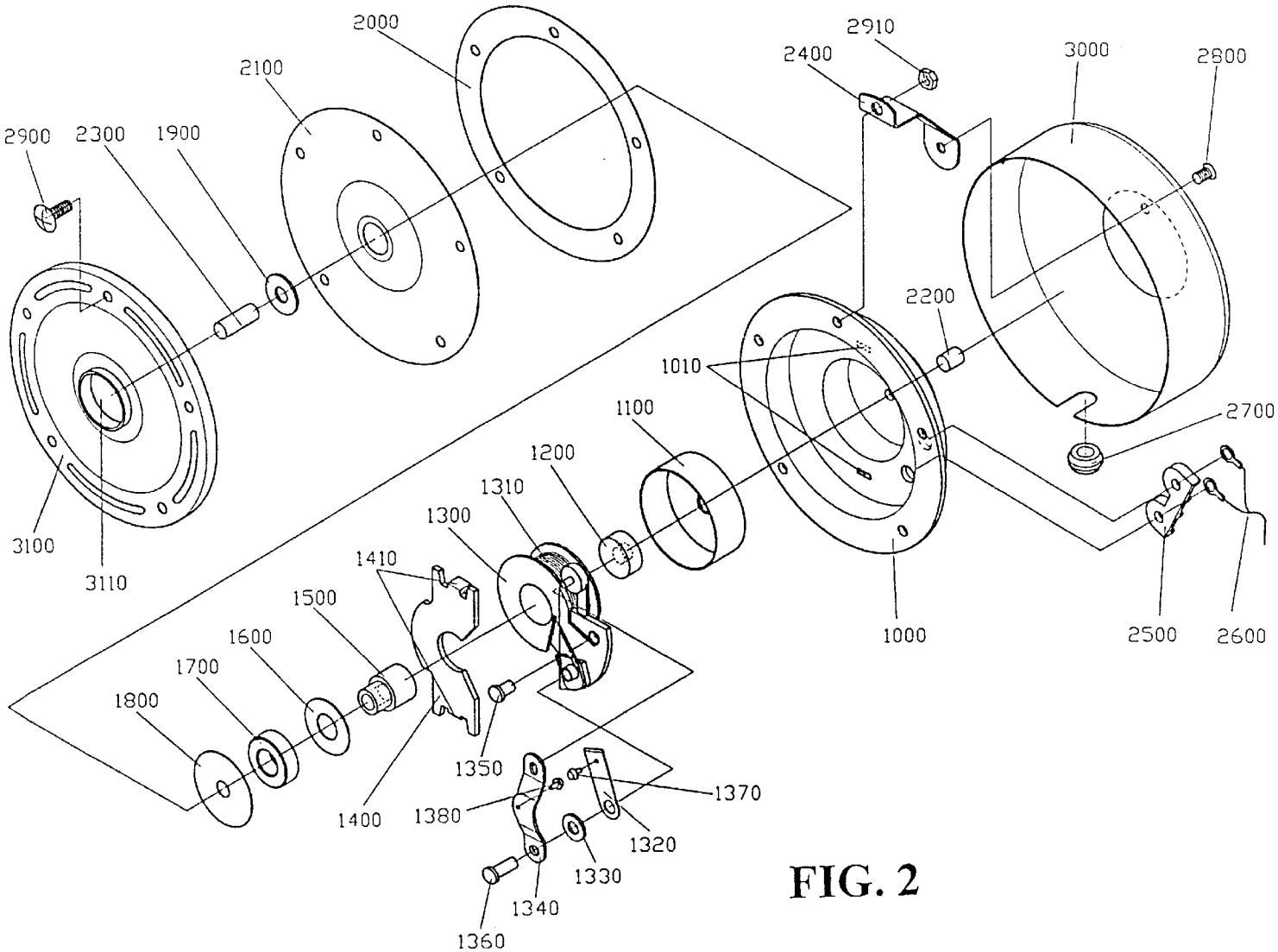
FIG. 2 is a perspective exploded view of a speaker structure used on ships in accordance with the present invention.
Figure 3:
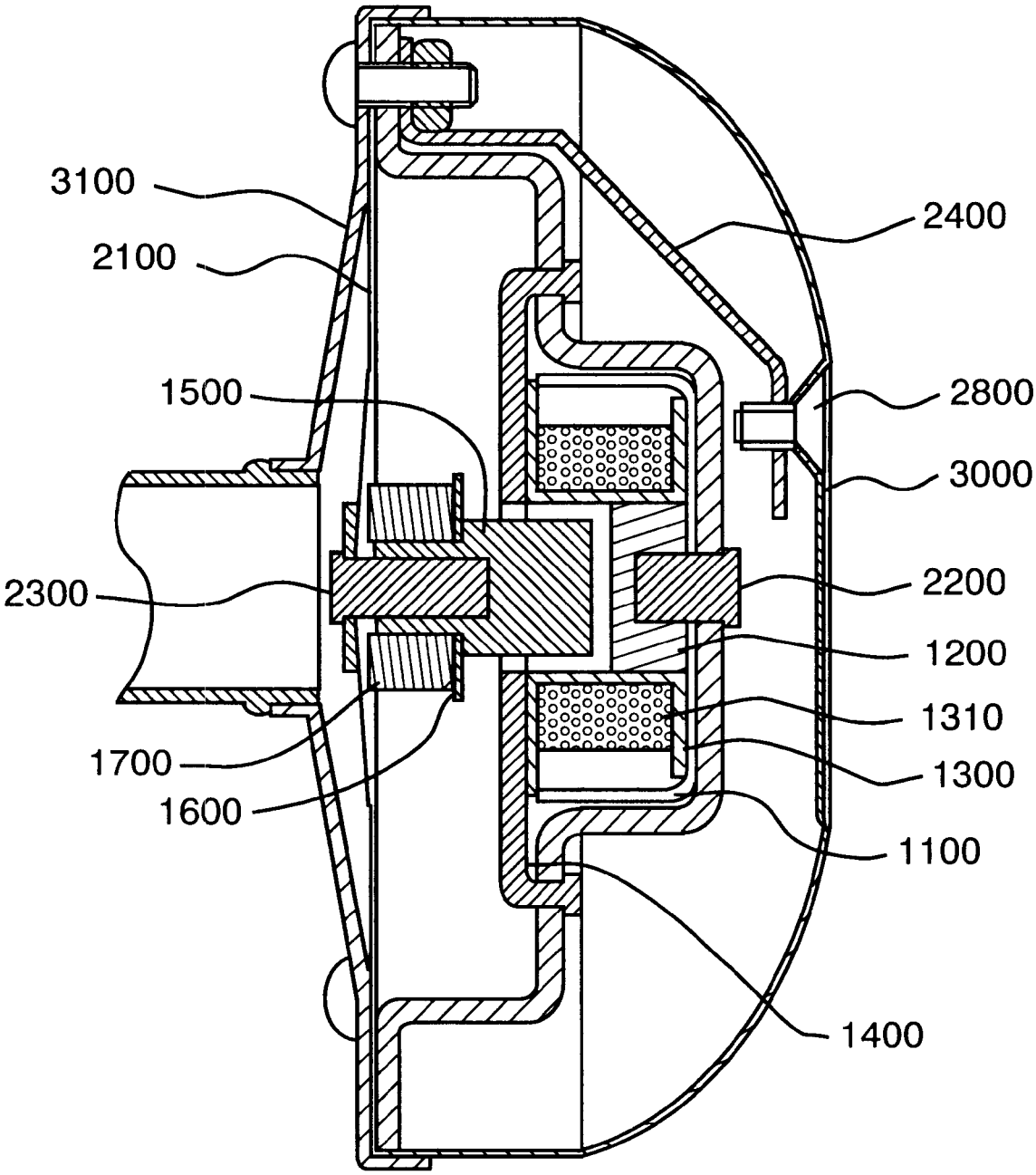
FIG. 3 is a sectional view of the speaker structure used on ships in accordance with the present invention.

Referring to the drawings, and in particularly FIGS. 2 and 3. there is shown a structure of speaker for use on ship. The speaker employs a coil housing 1100 to be mounted at a base seat 1000 (stainless steel) to provide magnetism concentration. A combination peg 2200 (stainless steel) is mounted within an iron block 1200. A pressing machine is used to cause the iron block 1200, the coil housing 1100, the base seat 1000 and the combination peg 2220 to form integrally as a unit. A coil seat 1300 is placed within the coil housing 1100 and a coil 1310 is wound around the coil seat 1300. The coil housing (1100) includes a lower surface and a body portion. The body portion of the coil housing (1100) contacts the upper surface of the coil seat (1300), as shown in FIG. 3. The coil seat (1300) includes an upper surface, a lower surface, and a body portion positioned between the upper surface and the lower surface of the coil seat (1300). The coil (1310) being would around the body portion of the coil seat (1300), as shown in FIG. 3. The coil (1310) is totally enclosed by an enclosure formed from at least the body portion of the coil seat (1300), the upper surface of the coil seat (1300) and the body portion of the coil housing (1100). When a current passes to the coil 1310, a magnet is formed and the iron block 1200 possesses magnetism. A mounting plate 1400 (stainless steel) is mounted onto the coil seat 1300. The top and the bottom of the mounting plate 1400 are individually provided with a mounting peg 1410 which can be mounted at a peg seat 1010 of the base seat 1000. The mounting peg 1410 can be connected at the base seat 1000 by means of the pressing machine.

The coil seat 1300 is rigidly mounted at the coil housing 1100. A vibration shaft 1500 is mounted with an annular rim

1600 and a heavy weight 1700, and a combination peg 2300 is used to combine a washer 1800 (stainless steel), a vibration board 2100 (stainless steel), a pad 1900 (stainless steel) and the vibration shaft 1500 together.

A pressing machine is used to combine all these parts into a unit. A screw 2900 (stainless steel) and a nut 2910 (stainless steel) are used to combine the vibration board 2100, a rubber pad 2000, the base seat 1000, a connection board 2400 (stainless steel) and a top cover 3100 (stainless steel). The rubber pad 2000 is used to prevent water moisture from entering into the interior of the speaker. A flat screw 2800 (stainless steel) is used to mount the housing 3000 at the connection board 2400. At the bottom of the housing 3000, a mounting rubber ring 2700 is provided to allow the passage of the power source wire.

Figure 4:
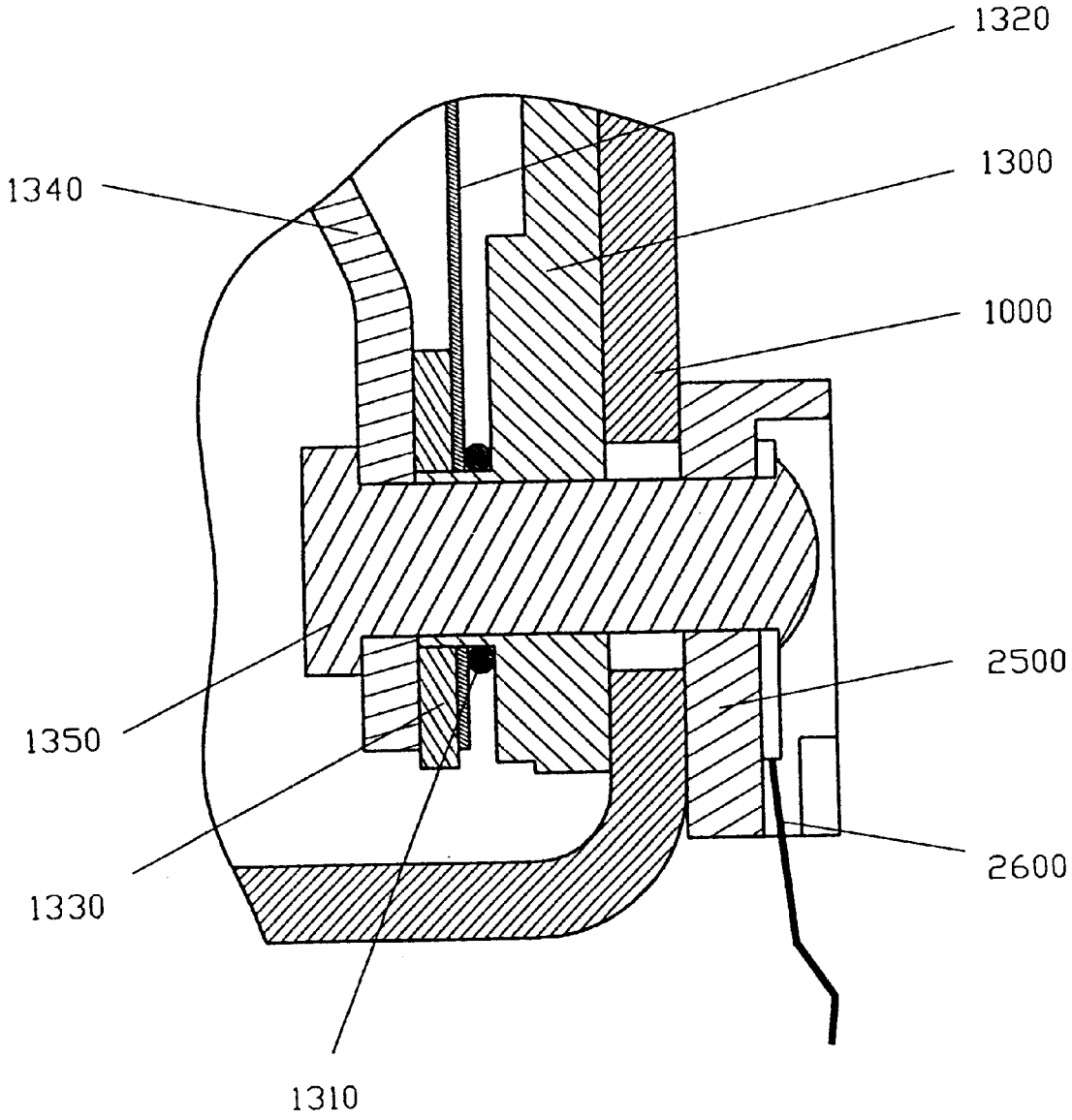
FIG. 4 is a sectional views of the conductive shaft in accordance smith the present invention.
Figure 5:
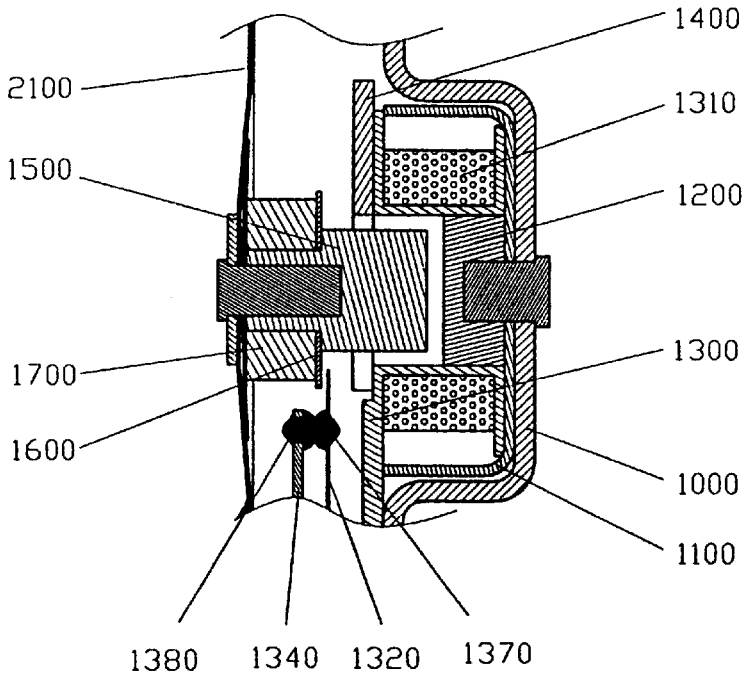
FIG. 5 is a sectional view of the structure of the speaker when the circuit is closed in accordance with the present invention.
Figure 6:
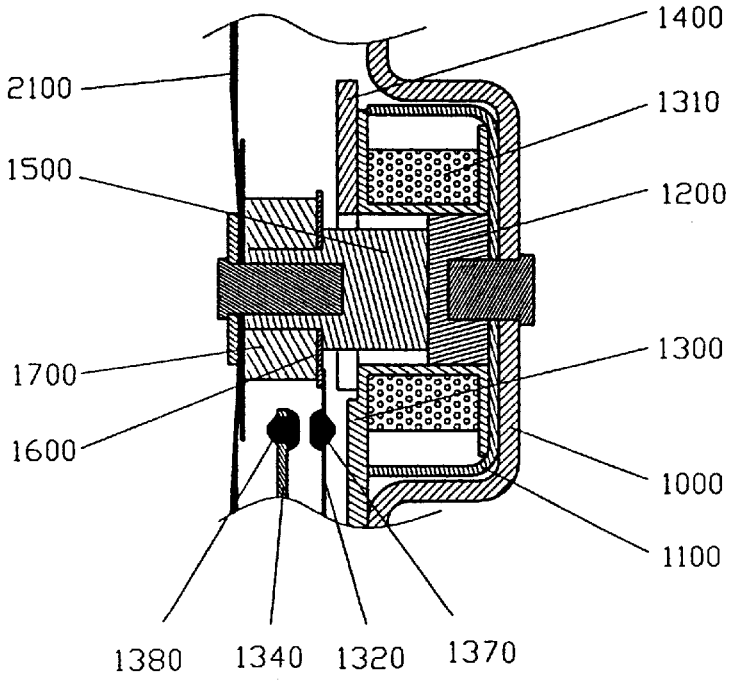
FIG. 6 is a sectional view of the structure of the speaker when the circuit is opened in accordance with the present invention.
Figure 7:
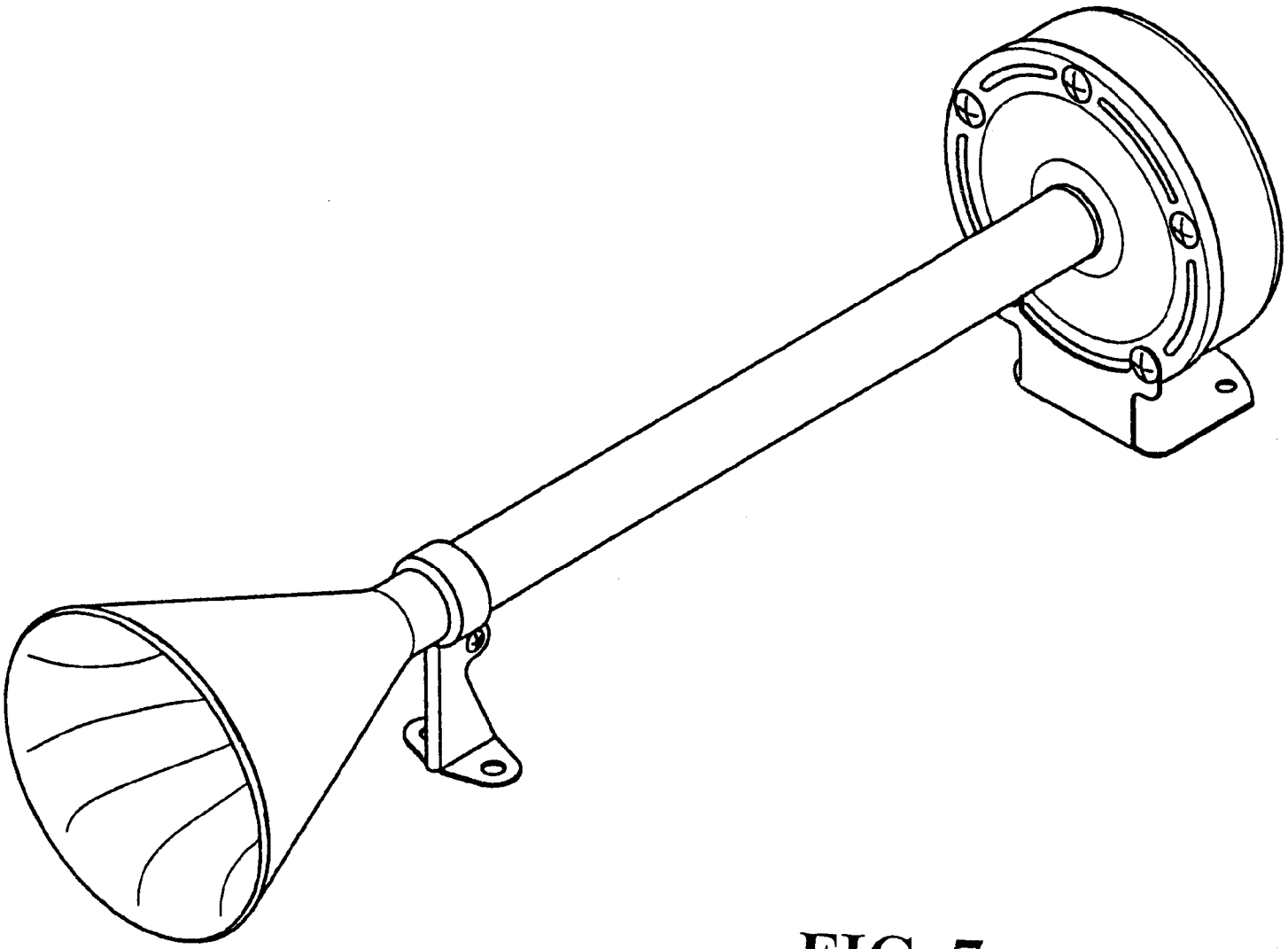
FIG. 7 is a perspective view of the speaker in accordance with the present invention.

Referring to FIGS. 4, 5 and 6, one end of the coil 1310 is connected to a conductive shaft 1350 and one end of the conductive shaft 1350 is connected to a power source wire 2600 via the base seat 1000 and an insulative blocking plate 2500. The other end of the coil 1310 is connected to a conductive plate 1320. A resistance coil 1330 is mounted to the conductive plate 1320 to prevent the current directly passes through the mounting plate 1340. The mounting plate 1340 is connected to the power source wire 2600 by the conductive shaft 1360, which passes through the insulative blocking plate 2500. The other end of the conductive plate 1320 is connected to a conductive device 1370 which contacts with the mounting plate 1340 to form a closed circuit. When current passes to the coil 1310, a magnetic field is formed at the coil 1310 and the iron block possesses magnetism to attract the vibration shaft 1500 to move downward. The heavy weight 1700 is used to increase attraction force by the iron block 1200 to cause the vibration board 2100 to move downward. When the vibration board 2100 mores downward, the annular rim 1600 contacts with the conductive plate 1320 which drives the conductive plate 1320 to press downward, and the conductive device 1370 is not in contact with the conductive device 1380 of the mounting plate 1340, which causes an opened circuit, and the coil 1310 cannot produce a magnetic field. The iron block 1200 does not possess magnetism, and the vibration board 2100 has the elasticity to restore the vibration shaft 1500 to its original position.

The annular rim 1600 moves upward and the conductive plate 1320 is not pressed. The conducting device 1370 of the conductive plate 1320 and the conductive device 1380 of the mounting plate 1340 are in contact. A closed circuit is formed. The alternate attracting and releasing actions cause the vibration board 2100 to vibrate and produce sound.

In accordance with the present invention, the majority of the parts of the speaker which exposed in the air are made from stainless steel (SS 304). As the bottom seat 1000 is made from stainless steel, which does not concentrate magnetism as that made from iron, the coil housing 1100 is mounted in between the base seat 1000 and the coil seat 1300 such that a magnetism concentration effect is obtained. Then current passes to the coil 1310, the coil 1310 produces a magnetic field. The coil housing 1100 allows the magnetism to concentrate on the iron block 1200. The magnetism produced by the iron block 1200 attracts the vibration shaft 1500 to move downward which drives the vibration board 2100. When the annular rim 1600 moves downward to press the conductive plate 1320, the circuit is cut off, and the magnetism is lost, then, the vibration board 2100 moves upward. The repeating attracting and releasing actions of the vibration board 2100 produce vibration, which in turn, produce sound effect.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A speaker for use on a ship, the speaker having a base scat, a vibration shaft, a vibration board connected to the vibration shaft, a coil and a coil seat containing the coil, comprising: a coil housing enclosing an iron block therein, said coil housing being mounted between the base seat and the coil seat, said coil housing having a coil housing position and said coil seat having a coil seat position, wherein said coil housing position is fixed relative to said coil seat position, wherein a magnetic force is formed when a current is passed through the coil, the magnetic force being concentrated at the iron block which in turn attracts the vibration shaft to move, thereby driving the vibration board to produce vibration and resulting in production of sound;

said coil scat including an upper surface, a lower surface, and a body portion positioned between said upper surface and said lower surface of said coil scat; said coil being wound around said body portion of said coil seat;

said coil housing including a lower surface and a body portion, said body portion of said coil housing contacting said upper surface of said coil seat; and wherein said coil is totally enclosed by an enclosure formed from at least said body portion of said coil seat, said upper surface of said coil seat and said body portion of said coil housing.

2. The speaker of claim 1, wherein the coil housing is made from iron.

3. The speaker of claim 1, wherein the vibration board is made from stainless steel.

* * * * *